US012435602B2

(12) United States Patent
Wichinescki

(10) Patent No.: US 12,435,602 B2
(45) **Date of Patent: *Oct. 7, 2025**

(54) METHOD OF CONFIGURING A SUBSEA ARRANGEMENT

(71) Applicant: AKER SOLUTIONS DO BRASIL LTDA, Sao Jose dos Pinhais Parana (BR)

(72) Inventor: Edenilson Wichinescki, Curitiba Parana (BR)

(73) Assignee: AKER SOLUTIONS DO BRASIL LTDA, Sao Jose dos Pinhais Parana (BR)

( * ) Notice: Subject to any disclaimer, the term of this patent is extended or adjusted under 35 U.S.C. 154(b) by 0 days.

This patent is subject to a terminal disclaimer.

(21) Appl. No.: 18/748,113

(22) Filed: Jun. 20, 2024

(65) Prior Publication Data

US 2024/0344430 A1 Oct. 17, 2024

Related U.S. Application Data

(63) Continuation of application No. 17/797,435, filed as application No. PCT/NO2021/050039 on Feb. 8, 2021, now Pat. No. 12,049,806.

(30) Foreign Application Priority Data

Feb. 6, 2020 (BR) ..... 10 2020 002512-0

(51) Int. Cl.
*E21B 43/01* (2006.01)

(52) U.S. Cl.
CPC ..... *E21B 43/0107* (2013.01)

(58) Field of Classification Search
CPC ..... E21B 43/0107; E21B 43/013
See application file for complete search history.

(56) References Cited

U.S. PATENT DOCUMENTS 4,452,312 A * 6/1984 Roblin ..... E21B 43/013 166/347
4,609,304 A * 9/1986 Labbe ..... E21B 33/037 166/347

(Continued)

FOREIGN PATENT DOCUMENTS

GB 2151288 A * 7/1985 ..... E21B 43/013
GB 2549102 A 10/2017
WO WO 2016/166534 A1 10/2016

*Primary Examiner* — Matthew R Buck
(74) *Attorney, Agent, or Firm* — Norman B. Thot

(57) ABSTRACT

A method of configuring a subsea arrangement to establish a fluid flow between a hydrocarbon well and a flow line. The method includes, in a subsea location, disconnecting a first connection profile from a flow line to restrict a fluid communication at a first fluid port and disconnecting a second connection profile from a subsea station to restrict a fluid communication at a second fluid port, retrieving a first retrievable connection module from a subsea location, providing a second retrievable connection, and connecting a second connection profile of a second retrievable connection module to the subsea station so as to permit a fluid communication between the hydrocarbon well and a second fluid port, and connecting the first connection profile of the second retrievable connection module to the flow line so as to permit a fluid communication between the flow line and the first fluid port.

6 Claims, 7 Drawing Sheets

A

B

C

(56) References Cited

U.S. PATENT DOCUMENTS

| | | | | |
|---|---|---|---|---|
| 6,481,504 | B1 * | 11/2002 | Gatherar | F16L 1/26 166/344 |
| 8,960,300 | B2 | 2/2015 | Cosgrove et al. | |
| 10,174,575 | B2 * | 1/2019 | Donald | E21B 33/076 |
| 11,293,251 | B2 * | 4/2022 | Donald | E21B 43/013 |
| 11,512,550 | B2 * | 11/2022 | Kvarme | E21B 19/16 |
| 12,049,806 | B2 * | 7/2024 | Wichinescki | E21B 43/0107 |
| 2004/0079532 | A1 | 4/2004 | Allen et al. | |
| 2012/0193102 | A1 | 8/2012 | Cosgrove et al. | |
| 2012/0273213 | A1 * | 11/2012 | Blalock | E21B 17/017 166/341 |
| 2017/0328163 | A1 * | 11/2017 | Shirani | E21B 43/013 |
| 2018/0112527 | A1 | 4/2018 | Donald et al. | |
| 2019/0120020 | A1 | 4/2019 | Rageot et al. | |
| 2020/0408072 | A1 * | 12/2020 | Donald | E21B 41/0007 |
| 2022/0090471 | A1 * | 3/2022 | Donald | E21B 41/0007 |

* cited by examiner

B

A

B

A

METHOD OF CONFIGURING A SUBSEA ARRANGEMENT

CROSS REFERENCE TO PRIOR APPLICATIONS

This application is a continuation of application Ser. No. 17/797,435, filed on Aug. 4, 2022, which is a U.S. National Phase application under 35 U.S.C. § 371 of International Application No. PCT/NO2021/050039, filed on Feb. 8, 2021 and which claims benefit to Brazil Patent Application No. 102020002512-0, filed on Feb. 6, 2020. The International Application was published in English on Aug. 12, 2021 as WO 2021/158124 A1 under PCT Article 21(2).

FIELD

The present invention relates to the field of subsea equipment for the flow of fluids to and from a subsea wells. The present invention more specifically relates to a retrievable connection module and to a subsea arrangement for establishing fluid flow in a subsea well.

BACKGROUND

Subsea equipment, such as Christmas trees, manifolds, modules and line terminations, etc., may currently comprise one or more locking devices and/or control fittings in order to establish and/or monitor the production or injection of a fluid flow in a subsea hydrocarbon well.

In some cases, a manifold may be positioned at the location of a subsea well, or subsea wells, and may assist to direct production from various wells into a flow line. In cases where injection into a well is desired, the manifold may assist to distribute a flow of fluid from a flow line and into a subsea well, or various subsea wells. A Christmas tree may be installed in the subsea well to connect a subsea well with a manifold.

The flow of production or injection fluids in oil wells may currently be achieved by providing production or injection modules, which may be supported by and/or connected to subsea infrastructure. Such modules may be large and difficult to handle, and may therefore be installed on a long-term basis. Such installation may require the use of specialist installation equipment, and may be time consuming and expensive. Once the modules are installed, flow lines may then be connected to the modules in order to permit production and/or injection in the subsea wells.

Recovery may be a difficult and expensive process due to the size and the nature of the installation of the modules. There is therefore a need for a means of connecting a subsea well to a flow line, and to other subsea infrastructure, in a way that is inexpensive and which does not require the use of equipment that is difficult to handle. This lack of ease of recovery may mean that many modules cannot be modified, or are difficult to modify, during their lifespan, and therefore may require expensive and specific design processes to ensure that they are multifunctional long term.

The proposed arrangement eliminates the need for traditional subsea modules that may be difficult and expensive to handle and install. The proposed solution provides a simple way of connecting a subsea well to a flow line via subsea infrastructure, and may reduce the weight of the modules involved in the order of 60% without the requirement for complex operations during installation and retrieval of the modules. The modules involved may also be readily and inexpensively installed and retrieved, and may have a standard design so that one module can be swapped for another module, having similar geometric design, but having different capabilities.

The present invention provides an arrangement for establishing a fluid flow in a subsea well comprising a connection module that permits installation in a single operation, and permits recovery of the connection module without the requirement for demobilizing the flow line.

U.S. Pat. No. 6,481,504 describes a flow line connector having a first portion for mounting to a piece of subsea equipment as a wellhead, a second portion connected to an end portion of a flow line, each portion having a guide for connecting the parts and allowing rotation for axial alignment, providing a tight connection, the second connector part having a subsea equipment package, for example, coils, gas/water separators, gas blenders, pumps and the like for connection to the first piece of the subsea equipment.

WO 2016/166534 A1 describes a valve apparatus for a circulation system in a subsea production plant of gas and oil that includes an inlet for a production flow of the subsea production facility of oil and gas, an outlet for the workflow, and a flow control valve arranged between inlet and outlet, wherein a first circulation line in communication with a sampling circuit is disposed between the inlet and the flow control valve and a second flow line in communication with a sampling circuit is disposed between the outlet and the flow control valve, wherein the flow control valve can be operated to be partially closed to create a pressure difference between the first and second flow lines and thus push a production fluid into the sampling circuit.

US 2017/0328163 A1 describes an arrangement of subsea connectors with a built-in flow meter which is configured to protect a flexible flow line in subsea production management equipment.

US 2004/0079532 A1 describes a tubular support system with a tub for supporting at least one tubular member including a body with at least one access port for accessing a fluid channel opening of the support positioned within the tub, which serves to connect to a tubular member and have at least one fluid channel therethrough from a bottom surface to an outer surface, so that one or more control lines connected to a supported tubular (tube, casing, riser, tubing) can be placed in fluid communication with at least one fluid channel and, through an access port, the fluid channel can be placed in fluid communication with another apparatus, for example a surface control unit.

U.S. Pat. No. 8,960,300 B1 describes a subsea attachment system that includes a support unit with a first connector and a distribution unit including an outer structure to be unraveled and supported by the support unit and an internal structure that is movable within the outer structure.

The solution proposed by the present innovation, which relates to an arrangement for establishing fluid flow in a subsea well comprising connection module for establishing a fluid connection between a flow line and a subsea well, has not previously been described.

SUMMARY

An aspect of the present invention is to mitigate, alleviate or eliminate one or more of the above-identified deficiencies and disadvantages in the prior art and to solve at least the above mentioned problem.

In an embodiment, the present invention provides a method of configuring a subsea arrangement so as to establish a fluid flow between a hydrocarbon well and a flow line. The subsea arrangement is provided in a subsea location and comprises a subsea station, a subsea flow line, and a first retrievable connection module. The first retrievable connection module comprises a first fluid port and a first connection profile which is releasably coupled to the flow line so as to permit a fluid communication between the flow line and the first fluid port, a second fluid port and a second connection profile which is releasably coupled to the subsea station so as to permit a fluid communication between the hydrocarbon well and the second fluid port, and a utility arrangement which is configured to alter or to monitor an aspect or a characteristic of a fluid flow between the first fluid port and the second fluid port. The method comprises steps A-D. Step A requires, in the subsea location, disconnecting the first connection profile from the flow line so that the fluid communication at the first fluid port is restricted and disconnecting the second connection profile from the subsea station so that the fluid communication at the second fluid port is restricted. Step B requires retrieving the first retrievable connection module from the subsea location. Step C requires providing a second retrievable connection module having a first fluid port and a first connection profile, a second fluid port and a second connection profile, and a utility arrangement which is configured to alter or to monitor an aspect of a characteristic of a fluid flow between the first fluid port and the second fluid port, the utility arrangement having a different configuration to the utility arrangement of the first retrievable connection module. Step D requires, in the subsea location, connecting the second connection profile of the second retrievable connection module to the subsea station so as to permit a fluid communication between the hydrocarbon well and the second fluid port, and connecting the first connection profile of the second retrievable connection module to the flow line so as to permit a fluid communication between the flow line and the first fluid port.

BRIEF DESCRIPTION OF THE FIGURES

The present invention is described in greater detail below on the basis of embodiments and of the drawings in which.

DETAILED DESCRIPTION

Figure 1:
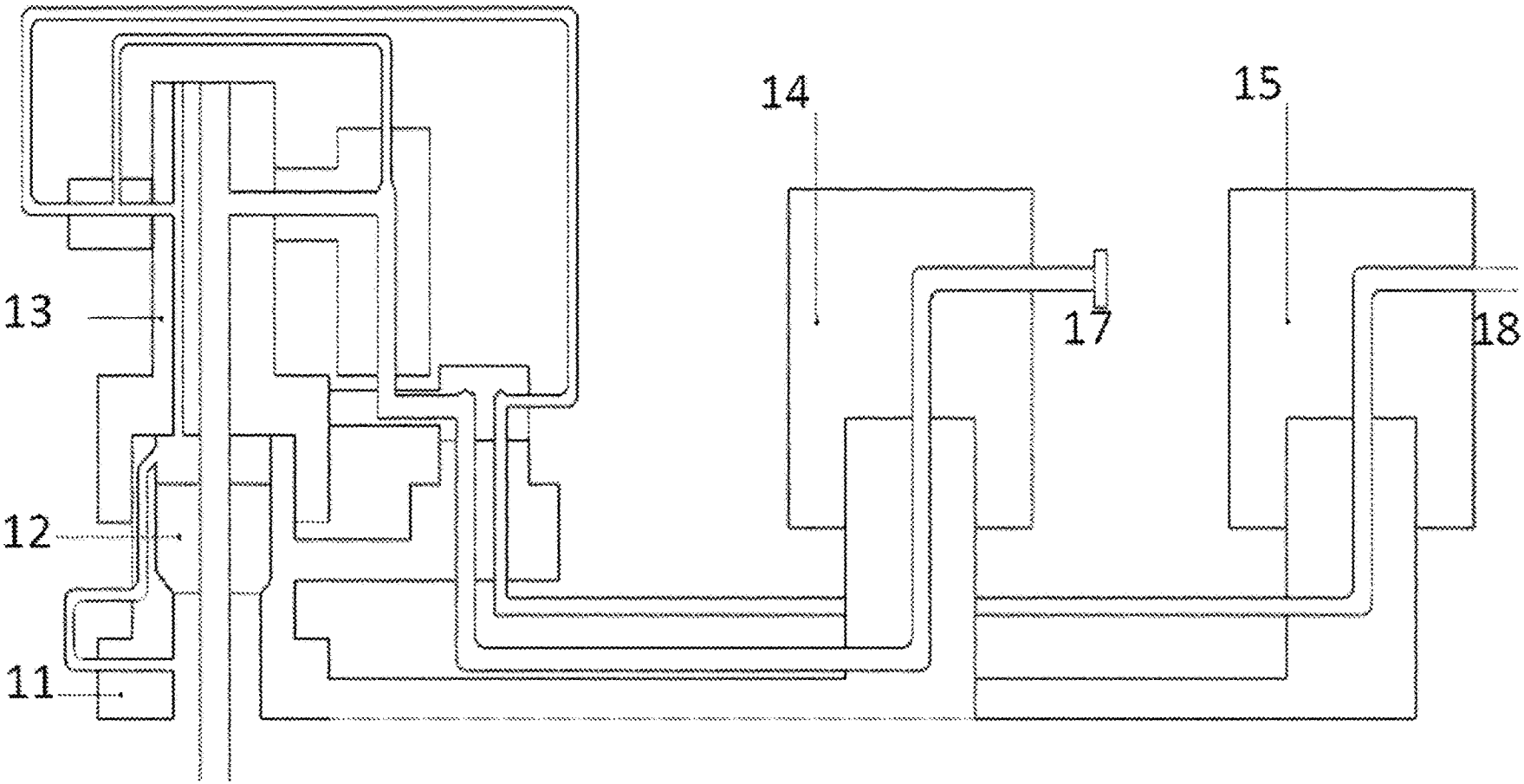
Fig. 1 (Prior Art)
FIG. 1 is a schematic illustration of a typical subsea Christmas tree arrangement 13 comprising a production base 11, showing a tubing hanger 12, a vertical connection module 14 for a production flow line 17 and a vertical connection module 15 for an annulus flowline 18.

A first aspect of the present invention provides a retrievable connection module for establishing a fluid flow between a subsea station and a subsea flow line, the retrievable connection module comprising:

- a first fluid port and a first connection profile, and a second fluid port and a second connection profile;
- a utility arrangement configured to alter or monitor an aspect or characteristic of fluid flow between the first fluid port and the second fluid port;
- the first connection profile being releasably couplable to a flow line to permit fluid communication between the flow line and the first fluid port; and
- the second connection profile being releasably couplable to a subsea station to permit fluid communication between a subsea well and the second fluid port;
- wherein the first connection profile is configurable to disconnect a flow line in a subsea location and fluid communication at the first fluid port be restricted, and the second connection profile is configurable to disconnect from a subsea station in a subsea location and fluid flow at the second fluid port be restricted.

The subsea station may be a subsea manifold station, or may additionally or alternatively be or comprise a subsea storage station (e.g., a storage station for nitrogen, hydrogen, ammonia or some other working fluid or chemical), a pump station, an in-line T structure, or the like.

According to a second example, the utility arrangement may comprise at least one of a flow meter, a pressure regulator, a valve, a pump, a coil, an electrical transformer, a fluid separator and a sensor.

According to a third example, the first fluid port may be oriented orthogonally relative to the second fluid port.

According to a fourth example, the first fluid port may be oriented opposing the second fluid port.

According to a fifth example, the first fluid port may be oriented obliquely relative to the second fluid port.

According to a sixth example, the connection module may comprise a handling profile for engaging the connection module and for retrieval of the connection module from a subsea location.

According to a seventh example, the subsea station may be a subsea manifold structure.

According to an eighth example, the first connection profile may be located adjacent the first fluid port, the second connection profile may be located adjacent the second connection port, and the first connection profile may be separately disposed on the connection module from the second connection profile.

A second aspect of the present invention provides a subsea arrangement for establishing a fluid flow between a subsea hydrocarbon well and a flow line, the subsea arrangement comprising:

- the retrievable connection module of the first aspect; and
- a subsea station comprising a manifold fluid port in fluid communication with the second fluid port of the retrievable connection module, and a manifold connection profile releasably coupled to the second connection profile of the retrievable connection module.

The station fluid port and the station connection profiles may be located on a subsea manifold, and therefore may be considered a manifold fluid port and manifold connection profile, respectively. In some examples, the station fluid port and the station connection profile may be located on a different type of station such as a pump station, compression station, in-line structure or the like.

The subsea station may be a subsea manifold station, or may additionally or alternatively be or comprise a subsea storage facility, a pump station, an in-line T structure, or the like. The manifold fluid port may likewise connect to a manifold, or may comprise part of a manifold or a similar subsea station.

According to a second example of the second aspect, the subsea arrangement may comprise a plurality of retrievable connection modules, wherein the subsea station may comprise a plurality of manifold connection profiles, and one of the plurality of retrievable connection modules may be releasably coupled to each of the plurality of manifold connection profiles.

According to a third example of the second aspect, a first of the plurality of retrievable connection modules may comprise a first utility arrangement comprising at least one of a flow meter, a pressure regulator, a valve, a pump, a coil, an electrical transformer, a fluid separator and a sensor, and a second utility arrangement comprising at least one of a flow meter, a pressure regulator, a valve, a pump, a coil, an electrical transformer, a fluid separator and a sensor, wherein the first component and the second component are different.

The present invention will be described in greater detail below under reference to the drawings.

The use of complex and/or large subsea structures and stations, such as subsea manifolds or Christmas trees, may require the installation of a variety of different modules and/or other subsea stations, in order to successfully communicate fluids between a well and a surface location. One such module may be a connection module 10, which may be used to connect a flow line to a flow of fluid being produced from, or being injected into, a subsea well. Using available connection modules 10, this may require complex and expensive operation, and may involve the use of specific, high-value vessels for mobilization over an extended period, and the existing connection may require mounting to a subsea location, which may again be time consuming and expensive.

A Christmas tree 13 houses a set of valves installed at the surface of hydrocarbon wells, and can be used to regulate its production. The function of a Christmas tree is to contain and control the production or injection of fluid into the well via a valve assembly, which can restrict/permit flow therethrough as desired. Subsea Christmas trees are used in offshore wells.

The subsea Christmas tree arrangement 13 of this example connects to a wellhead via a base structure mounted and is locked onto the wellhead via a connector, which in this case is a base adaptor 11. The base adaptor 11 (which may form part of the Christmas tree arrangement 13) is configured to house a tubing hanger 12, receive and lock the mounted Christmas tree 13 in position, and may receive connectors from a connection hub 1 (see, for example, A-C of FIG. 6) in the form of jumpers or flow lines coupled to a subsea manifold station and extending to the Christmas tree arrangement 13. This arrangement provided subsea may allow the removal of the Christmas tree from the Christmas tree arrangement 13 and permit intervention in a well without also having to uninstall production flow lines 17 from the subsea location.

FIG. 1 shows a schematic view of a typical arrangement of a subsea Christmas tree 13. Although not illustrated in detail, the Christmas tree arrangement 13 may comprise valves that are responsible for the operation and safety of Christmas tree 13 and associated subsea infrastructure. In FIG. 1, the well, which extends from the surface of the seabed to a subterranean hydrocarbon reservoir, can be divided into two parts: a production tubing, which may be inserted into the wellbore, for example, through a tubing hanger, Christmas tree 13, and BOP 11, and connects at the Christmas tree 13 to the production flow line 17; and the well annulus, which may be a space located between the inner wall of the wellbore and the outer wall of the tubing (e.g., production tubing) and connects at the surface to an the annulus line 18.

When pressure in the well is sufficiently high, for example, when the hydrocarbons in the well rise to the surface of the well under the pressure of the well itself, then the production fluid (e.g., the produced hydrocarbons) may pass through the Christmas tree 13 and through the production flow line 17 to a connection module 14. The connection module 14 may then direct the flow of production fluid through the flow line 4 (see, for example, FIG. 6) to the surface. If necessary, the Christmas tree 13 can also be used to restrict or prevent the flow of a production fluid therethrough (for example, by closing a valve therein) which may be useful in times where a break in production is required, for example, if subsea maintenance is required.

The pressure in the well may diminish over time. As the pressure diminishes, the natural pressure of the well may no longer be sufficient to bring hydrocarbons from the well to the surface, and therefore some sort of intervention may be required. One technique used to enhance production is the injection of gas (for example, a lift gas). In the example of FIG. 1, the lift gas may be injected through the annulus line 18. The lift gas then forces the hydrocarbons to rise from within the well, thereby enabling further production.

Although the connection module 14 of this example has a vertical configuration (i.e., the production flow line 17 enters the connection module 14 in a vertical configuration, as illustrated, in some examples, the connection module 14 may have a horizontal configuration. Where the production flow line 17 extends horizontally, rather than vertically, the connection module 14 may, for example, be considered to be horizontally connected.

The flow line may then extend to the surface from the connection module 14.

In order to produce hydrocarbons from a well efficiently, it is important to control both the volume and pressure of the production fluid, and therefore to obtain data relating to both these variables. With this data, it may be possible to understand when it is necessary to stimulate production, for example, with gas injection, when to choke production, or when no intervention is needed.

In some cases, there may be simultaneous production from a number of wellbores, each having its own Christmas tree 13. In this case, each of the Christmas trees 13 may direct a flow of production fluid towards a manifold that may collect and combine the production flow from each Christmas tree into a single flow line. The single flow line may then transfer the production flow to the surface. In this case, it is likely that the production fluid being produced at each well will be of a different pressure and have a different flow rate. In order to prevent wells of a higher pressure from interrupting the production of a well of a lower pressure as the production flow from each is combined in the manifold, it may therefore be necessary to regulate the pressure and flow rate of each well. This may be achieved through use of the valve arrangement of the Christmas trees to provide that the output pressure and flow rate from each Christmas tree is compatible with hydrocarbon production from each of the Christmas trees. Control of the pressure and flow rate from each well may alternatively be achieved at the location of the manifold, for example, via a valve or valve arrangement on a connection module that is mounted on the manifold.

In cases where well stimulation is required (for example, when the well pressure has dropped below a level required for production that is stimulation free), it may be necessary to inject a lift fluid into the well, which may be gas or water. In order to achieve a desirable flow rate of production fluid from the well, it is again necessary to monitor and control the pressure and flow rate of this injection fluid.

In some examples, a utility module may be present to assist in the monitoring of characteristics and aspects of fluid flow, such as flow rate and pressure, flow composition, or the like. Such modules are typically large and expensive to install and manufacture. This means that the installation of a utility module (for example, as shown in FIG. 2) may have a major impact on the cost and time involved in installing one in a subsea location.

Figure 2:
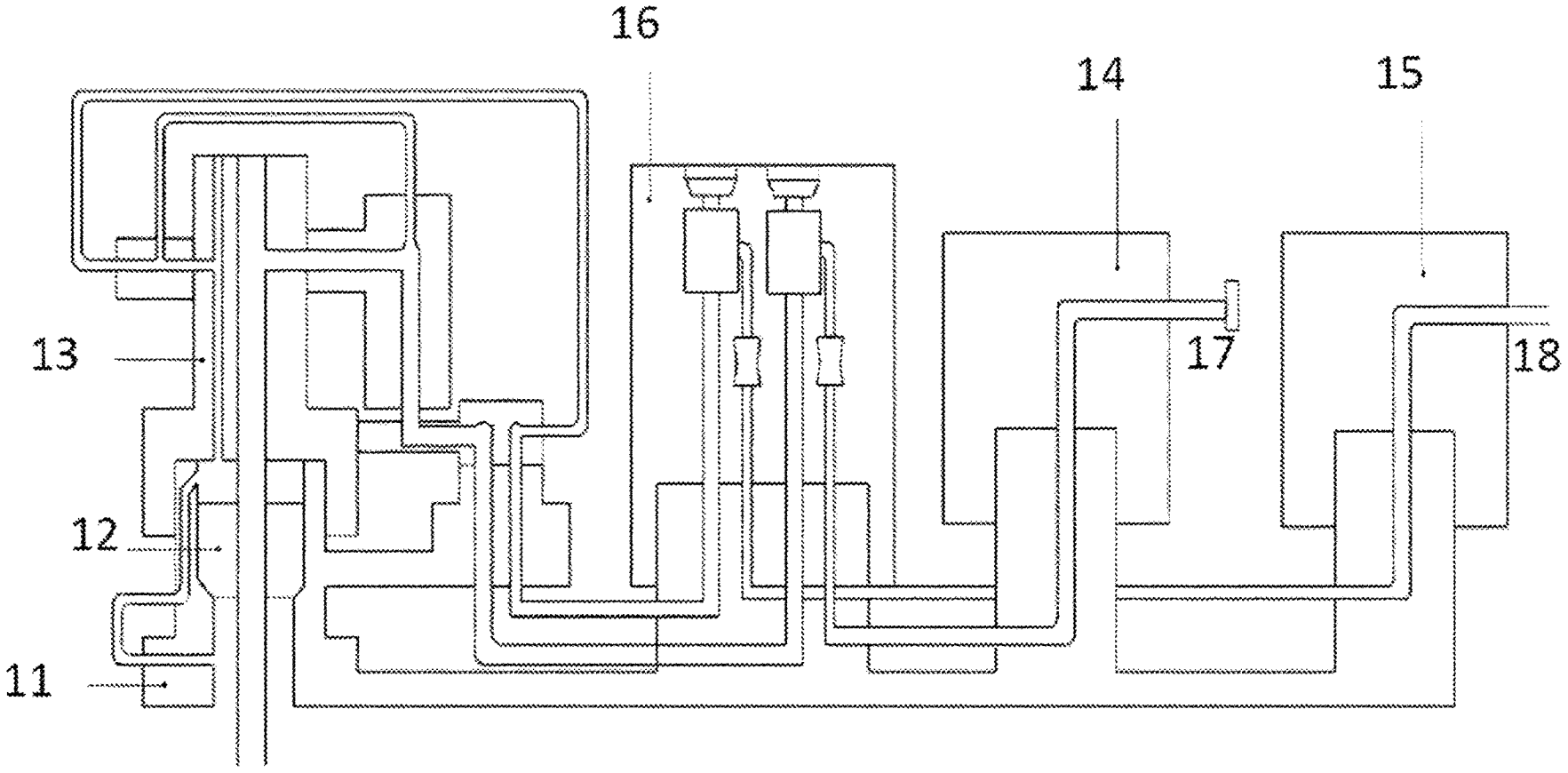
Fig. 2 (Prior Art)
FIG. 2 is a schematic illustration of a typical subsea Christmas tree arrangement 13 installed on a production base 11, showing a tubing hanger 12, a utility module 16, a vertical connection module 14 for a production flow line 17, the vertical connection module 15 of the annulus line 18, the production flow line 17 and the annulus line 18.
Figure 3:
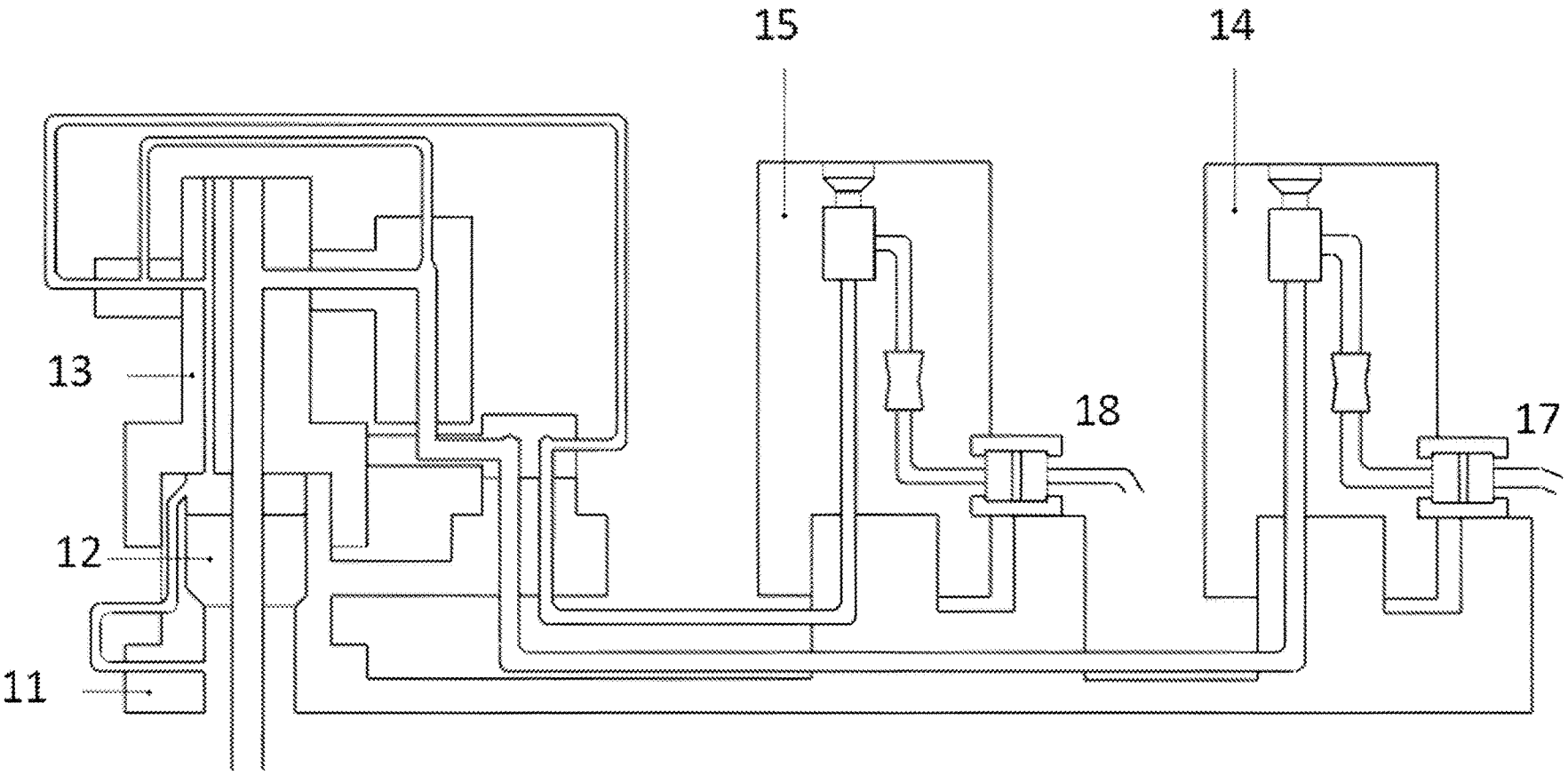
FIG. 3 is a schematic illustration of an embodiment of the retrievable connection module of the present invention, including a typical subsea Christmas tree arrangement 13 comprising on a production base 11, showing a tubing hanger 12, a connection module 14 coupled to a production flow line 17, and a connection module 15 coupled to the annulus line 18.

The current practice of including the utility module 16, for example, containing a pressure and flow control module, in combination with a traditional Christmas tree arrangement 13 is represented in FIG. 2. At the center of FIG. 2, the utility module 16 is illustrated in fluid communication with the Christmas tree 13. The utility module 16 may alternatively be located in or adjacent the manifold, wherein the production flow line 17 may be diverted so that flow of production fluid and/or injection fluid passes through the utility module 16. In addition to passing through the utility module 16, production fluid or injection fluid may in this case also pass through the connection module 14.

Figure 4:
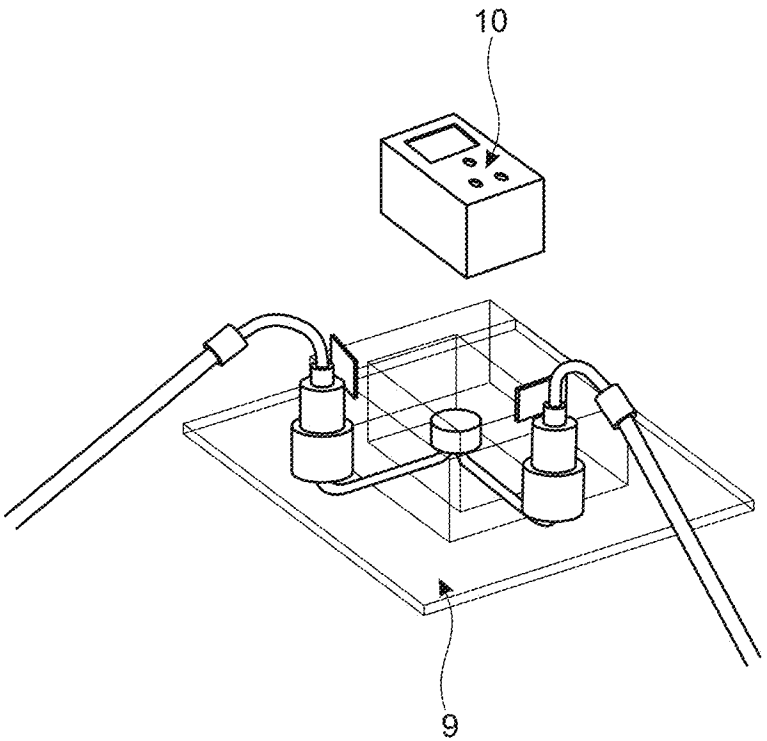
Fig. 4 (Prior Art)
FIG. 4 illustrates an example of the current state of the art, showing a subsea station 9 with a connection module 10 incorporated therein (A)
Figure 4:
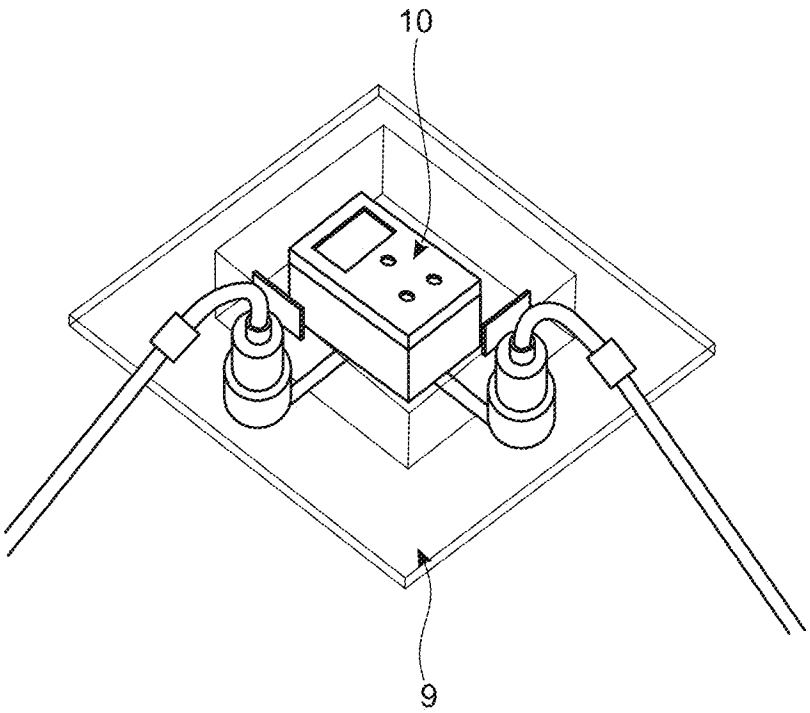
Fig. 4 (Prior Art)

Using known infrastructure, the utility module 16 may be required to be recoverable, for example, in order to maintain the valves and other components therein, that are necessary to control the pressure and flow rate of the fluid passing therethrough. As can be seen in FIG. 2, the utility module 16 may, however, comprise at four fluid channels or lines therein (for example, two inflow lines and two outflow lines), as well as a number of valves, and may comprise four connection points, or two dual bore connection points (such as the example of FIG. 4). This requires that the overall structure of the utility module is relatively large, particularly as compared to the connection module 14, 15 which connects each of the lines 17 and 18 to the Christmas tree 13.

Figure 5:
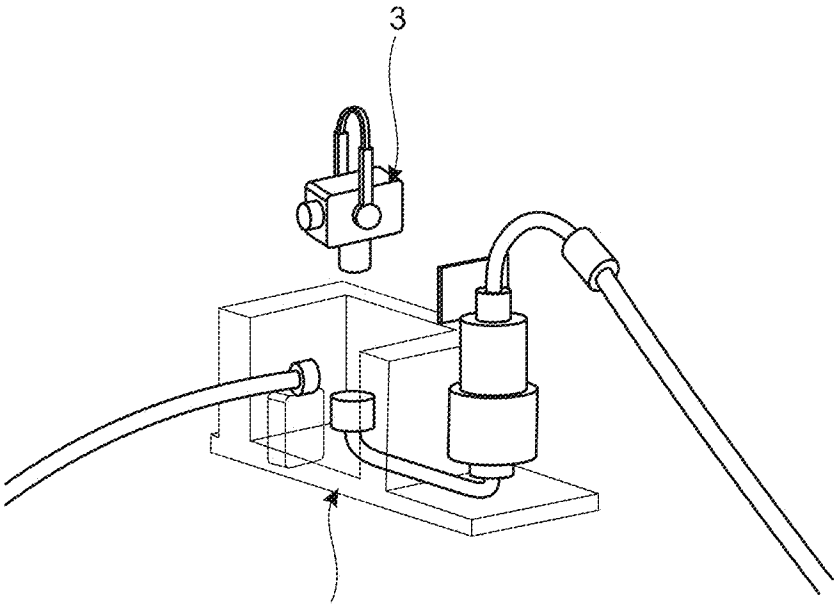
FIG. 5 illustrates an example according to the present invention, illustrating in A, a connection module coupled directly to a subsea station 9, and also shows in B the removal of the connection module, for example, for maintenance.
Figure 5:
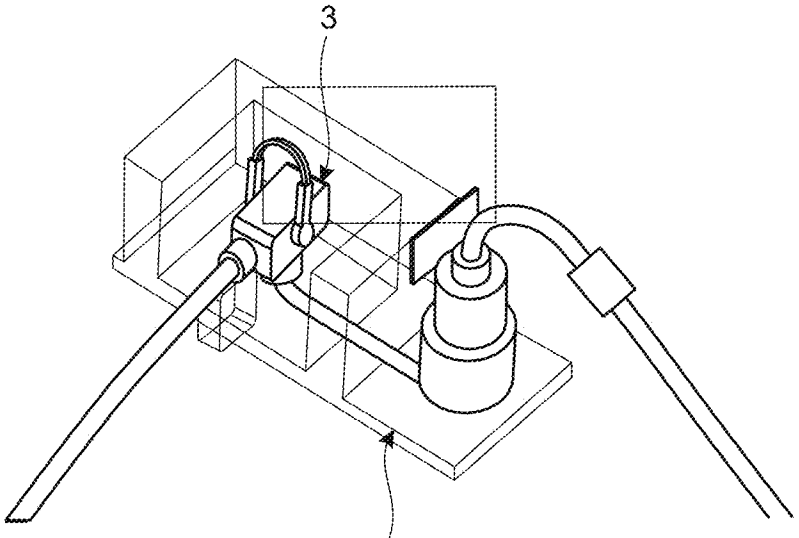

The presently disclosed subject matter relates to a connection module 3, first illustrated in A and B of FIG. 5, which may additionally comprise a utility arrangement. The utility arrangement may comprise, for example, a component that enables an aspect or characteristic of a fluid flow therethrough to be altered. The utility arrangement may, for example, comprise a control valve or valves, sensors, meters, or the like, and may be used to monitor or alter an aspect or characteristic such as the flow rate, flow pressure, flow composition, a degree to which flow is choked/restricted therethrough, etc. Alteration to the aspects or characteristics of the flow may additionally include routing and/or directing of fluid flow, which may include configuring the flow for injection, boosting (for example, boosting the pressure or flow rate of a fluid flow), or the like, for use at another subsea location.

Previously and as described, such components may have been located in the utility module 16, thereby requiring an independent connection that interrupted the flow line. In contrast the present disclosure permits a separation of the flow line 4 (see A and B of FIG. 5) from the utility arrangement, therefore permitting a user to recover the equipment without the need to demobilize the flow line 4. In the context of the present invention, a flow line 4 may refer to any subsea conduit, for example, a subsea well jumper. The complexity, size, weight and cost of the equipment is thus significantly lower compared to the previously described methods of including the utility module 16 as part of the Christmas tree 13 or the manifold. A user may additionally have access to a plurality of connection modules 3, each having a standard geometry but with differing utility arrangements. A user may therefore be able to easily retrieve one connection module 3, which may be used for one purpose (for example, it may provide a user with the ability simply to measure the pressure of a fluid flow in the connection module 3), and replace the first connection module 3 with another connection module 3 having a different function (for example, to provide a choking to a fluid flow therethrough). A plurality of connection modules 3 may additionally or alternatively be located subsea (for example, each of the plurality of connection modules 3 being connected to a single manifold structure), and each of the connection modules 3 may have a standard geometry but with a differing utility arrangement depending on the specific function of each of the connection modules 3 (for example, depending on whether the connection module 3 is being used to direct fluid from a high or low pressure well, being used for injection or production of fluid, etc.).

In addition to removing an interruption to the flow line 4, the presently disclosed subject matter additionally allows the utility arrangement to be provided at the point of connection of the flow line with the manifold, or with the Christmas tree arrangement 13. Each flow line (both the production flow line and the annulus flow line-which may be considered to be an injection flow line) connect to both the manifold and the Christmas tree arrangement 13 separately, then this permits the utility arrangement for both production and injection to be separated, also permitting the valves to be controlled, as well as retrieved/replaced separately. In contrast, previously described methods may provide one single utility module 16 comprising both utility components for injection and production, thereby allowing a user less flexibility, both in terms of valve control, and in terms of valve retrieval.

In addition, in cases where there is a well where only production is required, it may be possible to provide a connection module 3 according to the present invention to only a production line, without requiring significant changes to the subsea infrastructure. In cases where only injection is required, it may likewise be possible to provide a connection module for connection only to an injection line.

For each connection module, the exact components comprised in the utility arrangement may be able to be selected by a user depending on their requirements. For example, in cases where flow from the well is relatively low, or relatively predictable, a user may simply require a connection module 3 that does not monitor or alter aspects or characteristics of the flow. In such cases, the components of the utility arrangement may be kept to a minimum. In such examples, the utility arrangement may comprise only a flow meter, a pressure sensor, a valve, or the like. However, in other cases, for example, as the pressure in the well becomes depleted, a user may require more from the utility arrangement, and as such, the utility arrangement may be equipped with multiple sensors, valves, or the like. As the characteristics of the well changes over time, the user may be able to simply replace one connection module with another, which is better equipped, and/or more appropriately equipped, given the characteristics of the well, and this may be achieved without, or with minimal, disturbance to the surrounding subsea infrastructure.

Figure 6:
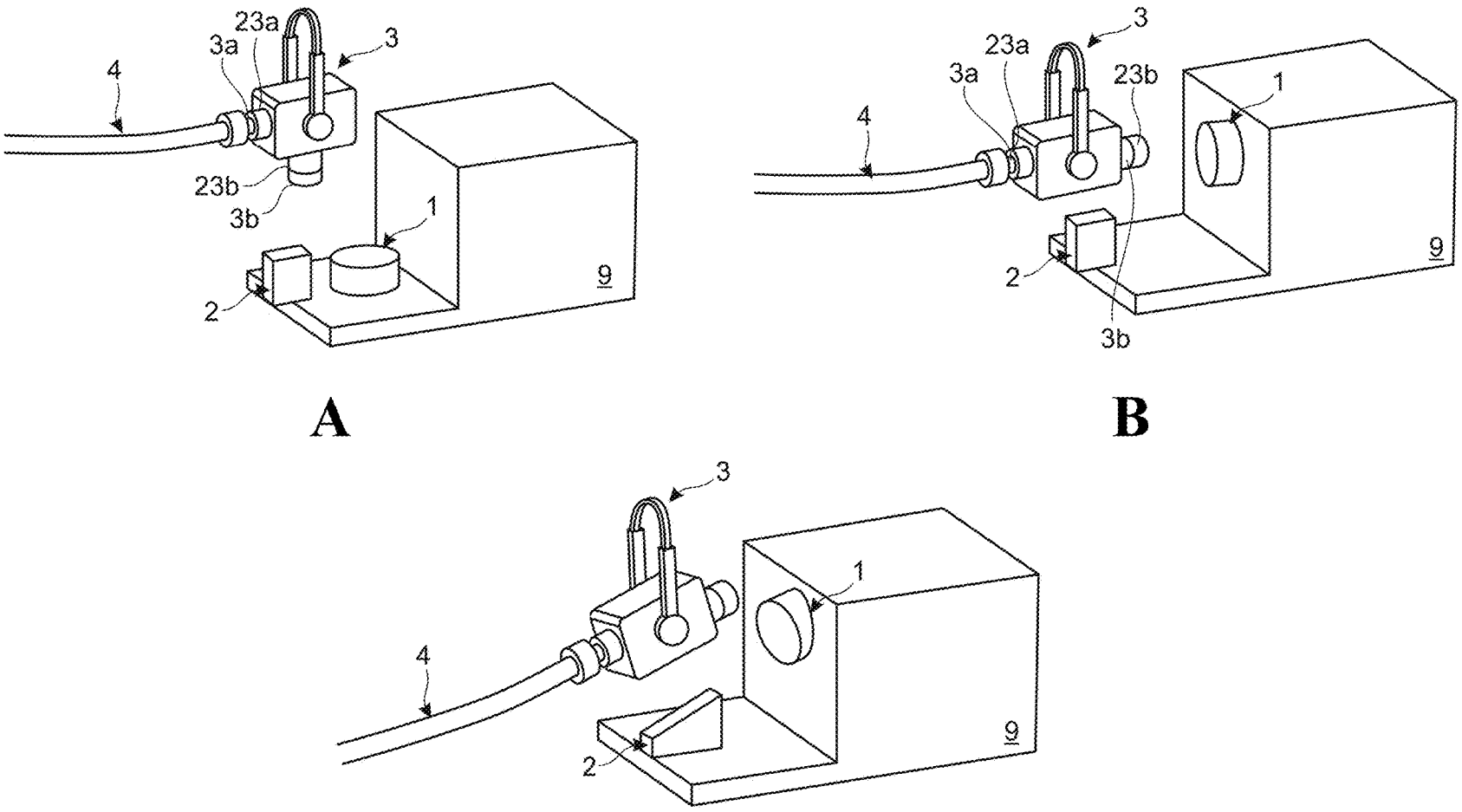
FIG. 6 illustrates various connection configurations of a connection module, here: vertical-axis A, horizontal-axis B and oblique-axis C, showing a connection module and a connection hub 1 of a subsea station 9 and a support 2 for the flow line 4.

Various configurations for the connection of a connection module 3 to a subsea station 9 are illustrated in A-C of FIG. 6. In FIG. 6A, a connection module 3 is illustrated which is fluidly coupled to a flow line 4. In FIG. 6A-C, the connection module 3 is illustrated as comprising a first fluid port 3*a*, which is connected via a first connection profile 23*a* to the flow line 4 so as to permit fluid communication therebetween. Also illustrated is a second fluid port 3*b* and a second connection profile 23*b*. In this example, the first connection profile 23*a* is immediately surrounding the first fluid port 3*a* so as to form a first connection arrangement, and the second connection profile 23*b* is immediately surrounding the second fluid port 3*b* so as to form a second connection arrangement. In the example A of FIG. 6, the first fluid port 3*a* is oriented orthogonally relative to the second fluid port 3*b*. Although not shown in the illustration, a utility arrangement is incorporated into the housing of each connection module 3.

Illustrated in B and C of FIG. 6 are alternative examples of connection modules 3 where the first fluid port 3*a* is located opposite the second fluid port 3*b*.

Also illustrated in A-C of FIG. 6 is a connection hub 1, which is located on the subsea station 9, which may be a subsea manifold structure, or which may be alternatively or additionally a pump station (for example, comprising at least one pump for boosting the pressure, flow rate, etc. of a fluid flowing therethrough), or may be a compression station (for example, comprising at least one compressor), an in-line structure, or a storage station (for example, for storing nitrogen, hydrogen, ammonia or another chemical for use subsea). In each example, the connection hub 1 comprises a fluid port, and may additionally comprise a connection profile for securing the second fluid port 3*b* and second connection profile 23*b* thereto. In the example A of FIG. 6, the connection hub 1 has a vertical-axis orientation. In the example B of FIG. 6, the connection hub 1 has a horizontal-axis orientation, while in the example C of FIG. 6, the connection hub 1 has an oblique orientation. In each case, there is also provided a support 2, which may support the weight of the connection module 3 or of the flow line during the connection to the connection hub 1.

As is illustrated by the examples A-C of FIG. 6, the connection module 3 may be provided in a variety of configurations depending on the requirements and the geometry of the station and the connection hub 1 to which it is connected. Also as illustrated, the first and second connection profiles 23*a*, 23*b* are located adjacent (for example, around the periphery of) the respective first and second fluid ports 3*a*, 3*b*. It should also be noted that the first and second fluid ports and first and second connection profiles are separately disposed on the connection module 3 (i.e., they are not located adjacent one another, but so that a separate connection is required to each).

The subsea station 9 (which may be a subsea manifold structure) may be fixedly located subsea, for example, permanently located on the seabed. As such, retrieval of the station may not be intended. Instead, and as will be described, the associated connection module, or modules, may be easily retrieved. As such, having a utility arrangement contained within a connection module 3 provides a user with significant advantages as compared to a utility module forming part of the subsea station 9 because it allows a user to leave the subsea station 9 in place (which may be difficult to retrieve), and the user may instead be able to easily retrieve the connection modules 3. This then permits a user to readily change the components of a utility module if required. In cases where there are multiple subsea stations 9, a connection module 3 that is coupled to one subsea station may further be able to be disconnected, and reconnected to a second subsea station 9, thereby further producing cost savings. Having the subsea station 9 permanently located on the seabed, while still having the option to modify functionality of the overall subsea infrastructure, may permit the provision of a subsea station 9 that can be made of higher quality, and without incurring additional expenses involved with having to retrieve the subsea station 9, for modification or other reasons.

The subsea station 9 may comprise a plurality of connection hubs 1, each able to connect to a connection module 3. A user may thus be able to connect multiple flow lines 4 to the subsea station 9 at various points. As previously described, each of the connection modules 3 may have a standard geometry, but optionally with differing utility arrangements. This may enable the user to stock a large number of connection modules 3 for use when desired, and which may easily be installed/retrieved to/from a subsea location, providing a high degree of functionality at a low cost.

Figure 7:
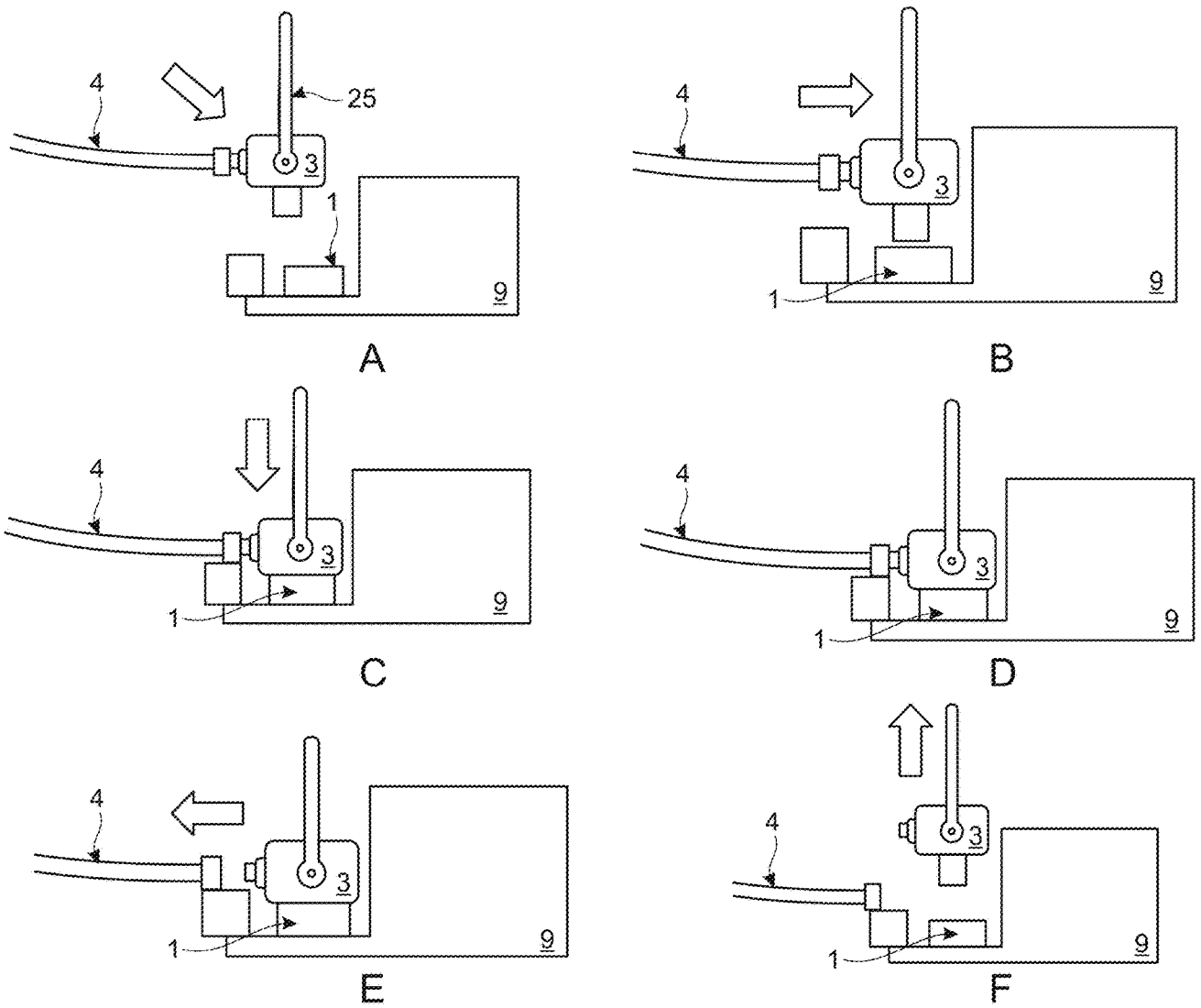
FIG. 7 is an illustration of a sequence for the installation and removal of a connection module 3 to a subsea station 9 via a first connection hub 1, and illustrating the disconnection of a flow line 4.

FIG. 7 illustrates various steps a-f that may be involved in the installation and retrieval of a connection module 3. In steps a to d, installation of the connection module 3 is illustrated as being in one single operation, involving bringing the connection module into the proximity of the subsea station 9, aligning the second fluid port 3*b* and second connection profile 23*b* with the connection hub 1 on the subsea station, and engaging/seating the second fluid port 3*b* with the connection hub 1. The connection module 3 may then be locked in place by locking the second connection profile 23*b* with a connection profile of the connection hub 1.

Steps e and f of FIG. 7 illustrate the retrieval of a connection module 3 from the subsea station 9. The flow line 4 may here be disconnected from the first fluid port 3*a* and first connection profile 23*a* thereof, and the connection module 3 may then be removed, without the need to also remove the flow line 4. During removal of the connection module 3, the flow line may simply be rested on the seabed, or another subsea location, until reconnection is desired.

In each example, the connection module 3 comprises a handling profile 25 to permit handling of the connection module 3 subsea. The handling profile 25 is in this case in the form of a U-shaped handle, although other shapes and configurations of handling profiles may be envisaged.

After removal of the connection module 3, it may be possible to reinstall the same (for example, a repaired) connection module 3, or a different connection module 3, for example, one with a modified utility arrangement, as compared to the previous.

It should also be noted that, in the case where the connection module 3 is absent, it may also be possible to connect the flow line 4 directly to the connection hub 1. As such, the connection hub 1 may comprise a profile that is suitable for engaging and sealing with the outlet of the flow line 4, that is couplable to the first port of the connection module 3. As such, even in the absence of a connection module 3, flow between the flow line 4 and the subsea station 9 may continue, thereby avoiding an interruption in the flow of fluids therebetween (for example, production fluids or injection fluids).

Comparing the present connection module 3 to that previously described, it can be seen that installation, as well as removal and replacement, can therefore be completed in a much more simple, quick and cost effective manner.

The prior art, in contrast, is only able to provide a utility module (for example, such as that shown in FIG. 2) that is large, requires an interruption to the flow lines, and may comprise utility components (for example, valves, sensors etc.) for multiple flow lines. An operation to change such a utility module is therefore inevitably more complex, expensive and time consuming.

The use of the connection module 3 proposed herein additionally provides the following advantages over previously described systems and arrangements:

- reducing the number of lines, valves and fittings;
- reducing the size and weight of equipment required for installation of the modules;
- dispensing with a module having a the dual connector bore; and
- decreasing the trips required for installation or recovery of the equipment.

The connection module 3 also may permit connection with different types of connection hubs 1, as illustrated in FIG. 6: the vertical-axis connection system of A; the horizontal-axis connecting system of B; the oblique-axis connection system of C.

In order to enable its connection in different positions, the connection hub 3 may be provided with orthogonally positioned fluid ports (see A of FIG. 6), oppositely positioned fluid ports (see B of FIG. 6) or angled fluid ports (see C of FIG. 6) position, allowing its connection to subsea equipment of varying geometries. The corresponding connection profiles may be provided with electrical, hydraulic or mechanical actuation for locking and release with the connection hub 1.

The connection module 1 of the present invention is composed of a housing, and may be able to accommodate additional or varying components in a utility arrangement, such as, for example, a flow meter, pressure and temperature sensors, fluid composition sensors, or the like.

The handline profile may be any appropriate profile, and may vary depending on the equipment used to install the connection module 3. The connection module 3 may, for example, be a loop, shackle, threaded connection system or the like.

The geometric shape of the connection module 3 of the present disclosure may be selected base on operating conditions and may be able to be adapted as necessary. In each connection module 3, there is provided at least means for passing the production or injection fluids, for example, via a channel or flowpath therein, which connects the first and second fluid ports. The module optionally allows the passage of an inspection device for inspection or maintenance of the lines.

This present disclosure is not limited to the embodiments discussed or illustrated herein. The skilled reader will understand that modifications and additions may be made to the present disclosure without departing from the scope of the present invention. It is furthermore to be understood that the present invention is not limited to the specific examples disclosed, and that modifications and other forms are understood as included within the scope of the appended claims. While specific terms are employed herein, they are used in a generic and descriptive form only and not by way of limitation. Reference should also be had to the appended claims.

LIST OF REFERENCE NUMERALS

1 Connection hub
2 Support
3 Connection module
3*a* First fluid port
3*b* Second fluid port
4 Flow line
9 Subsea station
10 Connection module
11 Production base/base adapter/BOP
12 Tubing hanger
13 Christmas tree arrangement/Christmas tree
14 Connection module
15 Connection module
16 Utility module
17 Production flow line
18 Annulus line
23*a* First connection profile
23*b* Second connection profile
25 Handling profile

What is claimed is:

1. A method of configuring a subsea arrangement so as to establish a fluid flow between a hydrocarbon well and a flow line, the subsea arrangement being provided in a subsea location and comprising a subsea station, a subsea flow line, and a first retrievable connection module, the first retrievable connection module comprising:

a first fluid port and a first connection profile which is releasably coupled to the flow line so as to permit a fluid communication between the flow line and the first fluid port;

a second fluid port and a second connection profile which is releasably coupled to the subsea station so as to permit a fluid communication between the hydrocarbon well and the second fluid port; and a utility arrangement which is configured to alter or to monitor an aspect or a characteristic of a fluid flow between the first fluid port and the second fluid port;

the method comprising:

a step A of, in the subsea location, disconnecting the first connection profile from the flow line so that the fluid communication at the first fluid port is restricted and disconnecting the second connection profile from the subsea station so that the fluid communication at the second fluid port is restricted;

a step B of retrieving the first retrievable connection module from the subsea location;

a step C of providing a second retrievable connection module having a first fluid port and a first connection profile, a second fluid port and a second connection profile, and a utility arrangement which is configured to alter or to monitor an aspect or a characteristic of a fluid flow between the first fluid port and the second fluid port, the utility arrangement having a different configuration to the utility arrangement of the first retrievable connection module; and a step D of, in the subsea location, connecting the second connection profile of the second retrievable connection module to the subsea station so as to permit a fluid communication between the hydrocarbon well and the second fluid port, and connecting the first connection profile of the second retrievable connection module to the flow line so as to permit a fluid communication between the flow line and the first fluid port.

2. The method as recited in claim 1, wherein, the first retrievable connection module further comprises a first utility arrangement comprising at least one of a flow meter, a pressure regulator, a valve, a pump, a coil, an electrical transformer, a fluid separator, and a sensor, the second retrievable connection module further comprises a second utility arrangement comprising at least one of a flow meter, a pressure regulator, a valve, a pump, a coil, an electrical transformer, a fluid separator, and a sensor, and the first utility arrangement is different from the second utility arrangement.

3. The method as recited in claim 1, wherein the subsea station is a subsea manifold station.

4. The method as recited in claim 1, wherein, the subsea station comprises a support which is configured to support the flow line while the first connection profile is disconnected from the flow line in step A, and the method further comprises:

leaving the flow line on the support for the duration of each of step B, step C, and step D.

5. The method as recited in claim 1, wherein, the subsea station comprises a connection hub via which the second connection profile of the first retrievable connection module is connected to the subsea station and via which the second connection profile of the second retrievable connection module is connected to the subsea station, the flow line comprises an outlet, the connection hub further comprises a profile that is suitable for engaging and sealing with the outlet of the flow line, and the method further comprises:

after performing step A, connecting the flow line to the connection hub; and before carrying out step D, disconnecting the flow line from the connection hub.

6. The method as recited in claim 5, wherein the method further comprises:

resuming a fluid flow between the flow line and the subsea station while the flow line is connected to the connection hub.

* * * * *